US010709918B2

(12) United States Patent
Nikkarila

(10) Patent No.: US 10,709,918 B2
(45) Date of Patent: Jul. 14, 2020

(54) PREACTION SPRINKLER SYSTEM OPERATION BOOSTER

(75) Inventor: Juha-Pekka Nikkarila, Tervakoski (FI)

(73) Assignee: MARIOFF CORPORATION OY, Vantaa (FI)

( * ) Notice: Subject to any disclaimer, the term of this patent is extended or adjusted under 35 U.S.C. 154(b) by 981 days.

(21) Appl. No.: 14/409,674

(22) PCT Filed: Jun. 25, 2012

(86) PCT No.: PCT/FI2012/050658
§ 371 (c)(1),
(2), (4) Date: Dec. 19, 2014

(87) PCT Pub. No.: WO2014/001599
PCT Pub. Date: Jan. 3, 2014

(65) Prior Publication Data
US 2015/0321035 A1 Nov. 12, 2015

(51) Int. Cl.
*A62C 35/68* (2006.01)
*A62C 37/11* (2006.01)
*A62C 35/62* (2006.01)
*A62C 35/64* (2006.01)

(52) U.S. Cl.
CPC ..... *A62C 35/68* (2013.01); *A62C 35/62* (2013.01); *A62C 35/645* (2013.01); *A62C 37/11* (2013.01)

(58) Field of Classification Search
CPC ..... A62C 35/62; A62C 35/645; A62C 35/66; A62C 35/68
See application file for complete search history.

(56) References Cited

U.S. PATENT DOCUMENTS

| | | | |
|---|---|---|---|
| 687,148 | A | 11/1901 | Fortier |
| 1,669,443 | A | 5/1928 | Tyden |
| 1,765,422 | A | 6/1930 | Griffith |
| 1,790,467 | A | 1/1931 | Griffith |
| 1,930,580 | A | 10/1933 | Benson |

(Continued)

FOREIGN PATENT DOCUMENTS

| | | | |
|---|---|---|---|
| CN | 101027102 | A | 7/1997 |
| CN | 101076378 | A | 11/2007 |

(Continued)

OTHER PUBLICATIONS

International Search Report for application PCT/FI2012/050658, dated Jun. 25, 2012, 3 pages.

(Continued)

*Primary Examiner* — Alex M Valvis
(74) *Attorney, Agent, or Firm* — Cantor Colburn LLP

(57) ABSTRACT

A system includes a gas exhaust line, a valve coupling the gas exhaust line and a pipe, and a control unit generating a command to open and close the valve, the control unit opening the valve to vent gas from the pipe and closing the valve within a period of time. A method includes receiving a command at a valve to open in order to exhaust gas from a pipe of a sprinkler system through a line coupled to the valve, the command corresponding to a command to turn on a pump unit of the sprinkler system, determining that liquid provided at an output of the pump unit is present in the pipe, and receiving a command at the valve to close in order to prohibit a flow of the liquid through the line.

13 Claims, 2 Drawing Sheets

(56) References Cited

U.S. PATENT DOCUMENTS

| | | | | |
|---|---|---|---|---|
| 2,021,148 | A | 11/1935 | Hodgman, Jr. | |
| 2,071,789 | A | 2/1937 | Griffith et al. | |
| 2,072,634 | A | 3/1937 | Griffith et al. | |
| 2,575,469 | A | 3/1950 | Rider | |
| 2,731,091 | A | 1/1956 | Robbins | |
| 3,595,318 | A | 7/1971 | Merdinyan | |
| 3,727,878 | A | 4/1973 | Willms | |
| 4,286,668 | A | 9/1981 | McCormick | |
| 4,570,719 | A | 2/1986 | Wilk | |
| 5,971,080 | A | 10/1999 | Loh | |
| 6,732,808 | B1 * | 5/2004 | Sprakel | A62C 3/004 137/68.19 |
| 6,752,217 | B2 | 6/2004 | Reilly | |
| 2010/0181082 | A1 | 7/2010 | Green | |
| 2010/0263882 | A1 * | 10/2010 | Bodemann | A62C 35/62 169/17 |
| 2011/0000685 | A1 | 1/2011 | Matsuoka | |
| 2015/0034170 | A1 * | 2/2015 | Kochelek | A62C 35/58 137/15.04 |

FOREIGN PATENT DOCUMENTS

| | | | |
|---|---|---|---|
| CN | 1379691 | A | 5/2008 |
| CN | 201064634 | Y | 5/2008 |
| CN | 101553285 | A | 10/2009 |
| DE | 2611653 | A1 | 9/1977 |
| DE | 4133410 | A1 | 4/1993 |
| DE | 19601777 | A1 | 7/1997 |
| DE | 19949277 | A1 | 4/2001 |
| GB | 1411470 | A | 10/1975 |
| JP | H0386181 | A | 4/1991 |
| JP | H03143459 | A | 6/1991 |
| JP | 1995222817 | A | 8/1995 |
| JP | 2000237340 | A | 9/2000 |
| JP | 2006247237 | A | 9/2006 |
| WO | 2010030567 | A1 | 3/2010 |

OTHER PUBLICATIONS

Written Opinion for application PCT/FI2012/050658, dated Jun. 25, 2012, 6 pages.

Singapore Written Opinion from application SG 11201408465R, dated Nov. 18, 2015, 9 pages.

Chinese Office Action and Search Report for application 201280074246.2, dated Jun. 7, 2016, 13 pages.

Korean Office Action for application KR 10-2014-7033539, dated May 25, 2018, 11 pages.

* cited by examiner

PREACTION SPRINKLER SYSTEM OPERATION BOOSTER

BACKGROUND

In order to promote safety, it is desirable to engage a sprinkler system as quickly as possible in the event of a fire. For example, minimizing the delay between when a fire is detected and when the sprinkler system is fully dispensing water may help to minimize or eliminate damage.

Dry pipe sprinkler systems are in frequent use today. Dry pipe sprinkler systems provide advantages relative to wet pipe sprinkler systems. For example, due to the presence of water in the piping of a wet pipe sprinkler system, the wet pipe sprinkler system could be rendered inoperable at low temperatures if the water freezes. Conversely, the fact that water is not present in the piping of a dry pipe system until the system is engaged (e.g., a fire is detected) allows dry pipe systems to be used in cold environments, such as unheated buildings, parking garages, etc.

The National Fire Protection Association (NFPA) 13 standard provides that every sprinkler system shall fulfill the requirement that the system is working in full operation pressure within sixty (60) seconds after the first sprinkler has been activated. Such a requirement typically does not present an issue in connection with a traditional sprinkler system (e.g., a wet pipe sprinkler system) because water starts to flow immediately through the nozzle after sprinkler activation and in traditional dry pipe sprinkler systems due to low air pressure (e.g., a low total mass of air) in the pipe and the use of relatively large nozzles. Also traditional dry pipe sprinkler systems may face challenges in trying to meet the (60) second target when the dry pipe section volume is relatively large, though. Conversely, in water mist dry pipe systems, the air pressure is initially relatively large (e.g., approximately 25 bar) and the air channels of the nozzles are relatively small (e.g., approximately 1 mm in diameter). This combination of high air pressure and small nozzles in a water mist dry pipe system presents challenges in terms of obtaining full water pressure in a timely fashion.

BRIEF SUMMARY

An embodiment of the invention is directed to a system comprising: a gas exhaust line; a valve coupling the gas exhaust line and a pipe; and a control unit generating a command to open and close the valve, the control unit opening the valve to vent gas from the pipe and closing the valve within a period of time.

An embodiment of the invention is directed to a system comprising: a pipe of a sprinkler system; an exhaust line; a valve coupled to the exhaust line and the pipe; and a detection unit coupled to the exhaust line and configured to measure a parameter of the exhaust line to determine when liquid is in the pipe.

An embodiment of the invention is directed to a method comprising: receiving a command at a valve to open in order to exhaust gas from a pipe of a sprinkler system through a line coupled to the valve, the command corresponding to a command to turn on a pump unit of the sprinkler system; determining that liquid provided at an output of the pump unit is present in the pipe; and receiving a command at the valve to close in order to prohibit a flow of the liquid through the line.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
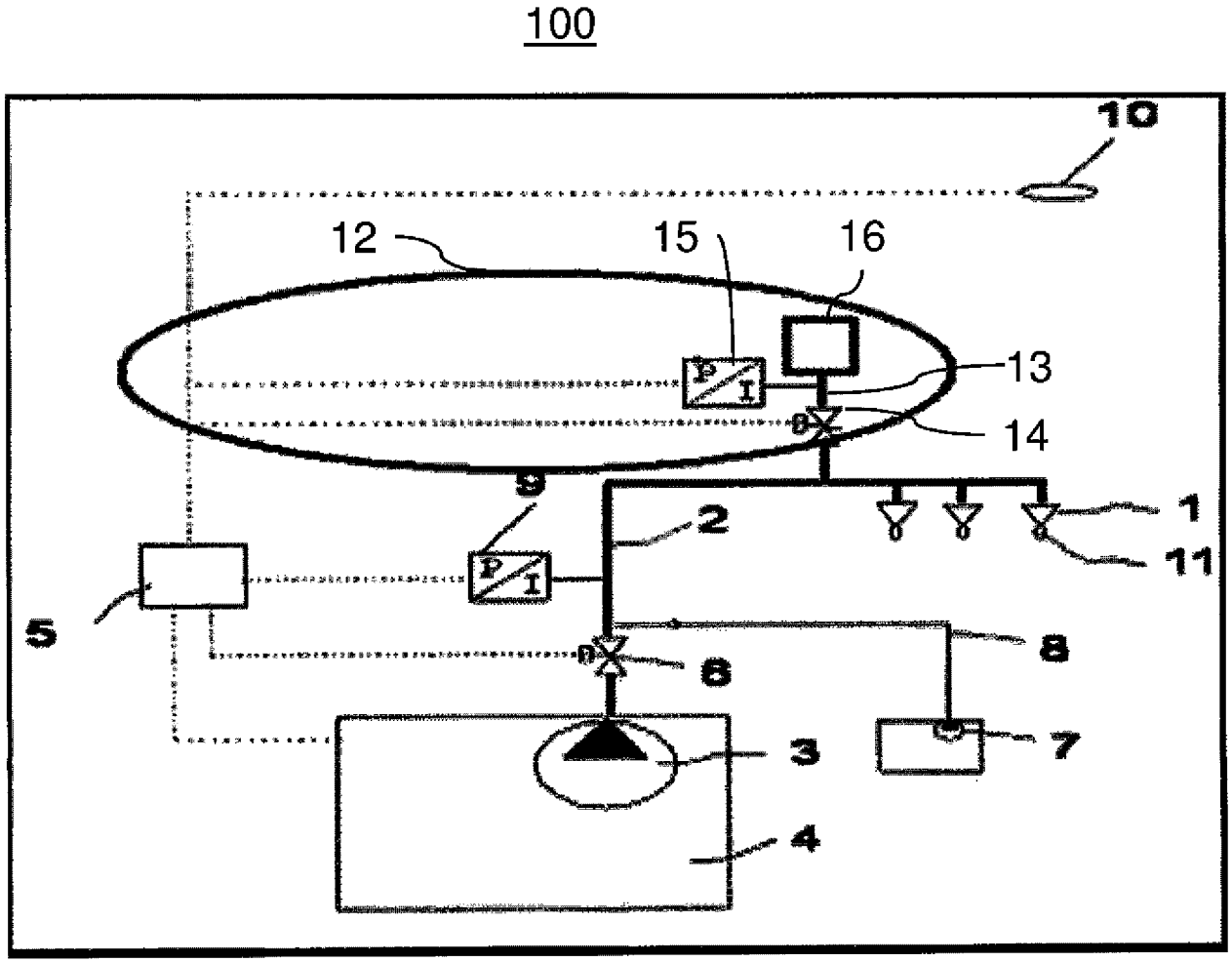
FIG. 1 illustrates an exemplary sprinkler system in an exemplary embodiment.

Exemplary embodiments of apparatuses, systems and methods are described for enhancing the operation of a sprinkler system. In some embodiments, operation may be enhanced by reducing a time it takes for the sprinkler system to achieve full operation (e.g., full water pressure output). While largely described in connection with a (water mist) dry pipe sprinkler system, the techniques and methodologies described herein may be adapted to accommodate other forms or types of sprinkler systems.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect.

FIG. 1 illustrates a system 100 in an exemplary embodiment. System 100 may be, or may be included as a part of, a sprinkler system. For example, system 100 may be a dry pipe sprinkler system. A portion 12 of system 100 may be used to evacuate a gas (e.g., air) in a timely fashion as is described further below.

System 100 may include one or more sprinklers 1. While three (3) sprinklers 1 are shown in FIG. 1, a given system may include more or less than three sprinklers 1. For example, the number of sprinklers 1 used in a given system may be based on any number of factors or conditions, such as the size of the area that is being protected from a fire, local or regional codes or regulations, etc.

Sprinklers 1 may be used to provide or supply fire extinguishing fluid, such as water, potentially in response to detecting a fire. In some embodiments, a determination that a fire is present may be based at least in part on a change in temperature. For example, a fluid contained in a bulb 11 of a sprinkler 1 may expand and burst bulb 11 such that the sprinkler 1 may become active in a manner known to those of skill in the art. Other techniques for determining or detecting that a fire is present may be used.

System 100 may include one or more pipes 2. Pipe 2 may be used to supply fluid originating from a fluid source (not shown in FIG. 1). In some embodiments, fluid might not be present in pipe 2 until system 100 is engaged. For example, in a dry pipe sprinkler system there may only be (pressurized) gas (e.g., air, nitrogen) in pipe 2 until a fire is detected.

Fluid may be driven into pipe 2 via one or more pump units 3. The pump unit 3 may be controlled via one or more controllers 4. In some embodiments, controller 4 may be integrated with pump unit 3. In some embodiments, controller 4 may be remote from pump unit 3. Controller 4 may supply one or more commands or directives to pump unit 3. For example, controller 4 may command pump unit 3 to turn on or supply fluid to pipe 2 in response to a detection of a fire, in response to a command to test various components or devices of system 100 (e.g., pump unit 3), or in response to any other condition. Controller 4 may command pump unit 3 to turn off, or cease supplying fluid to pipe 2.

System 100 may include a control unit 5. In some embodiments, control unit 5 may be remotely located from one or more of the other components or devices included in system 100. Control unit 5 may be associated with, or located at, a command-and-control center, a local or regional office, or at any other location. In some embodiments, control unit 5 may be integrated with one or more components or devices shown in FIG. 1.

Control unit 5 may issue commands or directives to one or more components or devices. For example, control unit 5 may direct controller 4 to turn on or turn off pump unit 3. Control unit 5 may direct a valve 6 to open or close. Valve 6 may be used to selectively enable fluid flow from (an output of) pump 3 to pipe 2 based on whether valve 6 is open or closed. Valve 6 may be configured to provide for fluid isolation. Fluid isolation may be used to troubleshoot a faulty component or device.

System 100 may include one or more compressors 7 to supply a compressed gas. For example, an air compressor 7 may be used to pressurize air in the system 100 (e.g., in pipe 2). The air may be pushed into pipe 2 via one or more air lines 8. In some embodiments, air may be pushed into pipe 2 by way of compressor 7 and air line 8 so as to blow-out or evacuate fluid from pipe 2. For example, in a dry pipe sprinkler system, it may be desirable to remove any fluid from pipe 2 following an introduction of the fluid to pipe 2 (e.g., following the introduction of fluid to pipe 2 as a result of a detected fire).

System 100 may include one or more detection units 9. Detection unit 9 may be coupled to pipe 2. Detection unit 9 may be configured to detect that one or more sprinklers 1 have been activated. For example, detection unit 9 may measure or monitor a pressure or a pressure derivative, gas flow, or any other parameter associated with pipe 2. In response to detecting that the measured parameter exceeds a threshold, detection unit 9 may determine that one or more sprinklers 1 are activated.

In response to determining that one or more sprinklers 1 are activated, detection unit 9 may transmit a message to, e.g., control unit 5 to inform control unit 5 of the sprinkler activation. In response to the message, control unit 5 may take one or more actions, such as issuing a command or directive to controller 4 to turn on pump unit 3.

System 100 may include one or more detection units 10. Detection unit 10 may transmit a message to, e.g., control unit 5 to inform control unit 5 of a flame or smoke detected by unit 10. Control unit 5 may turn on or enable one or more components or devices in response to the message. For example, control unit 5 may transmit a message to controller 4 to turn on pump 3 in response to the message received from detection unit 10. In some embodiments, detection unit 10 may serve as a back-up mechanism in the event that, e.g., a fluid contained in a bulb 11 of a sprinkler 1 fails to expand in the presence of a fire.

As shown in FIG. 1, system 100 may include a gas (e.g., air) exhaust system 12. Air exhaust system 12 may be configured to remove or exhaust gas (e.g., air) from pipe 2. For example, in some embodiments air exhaust system 12 may be configured to remove air from pipe 2 in a timely fashion. The time it takes to remove air from pipe 2 may be specified in accordance with one or more requirements or standards, such as the National Fire Protection Association (NFPA) 13 standard. NFPA 13 specifies that the time delay to achieve full fluid pressure in pipe 2 is to be no greater than sixty (60) seconds. Based on the use of air exhaust system 12, an approximate one-third (⅓) reduction in the time to achieve full fluid pressure may be realized (e.g., the time to achieve full fluid pressure may be approximately forty (40) seconds). The actual reduction or time savings realized in any given system 100 may be a function of, e.g., the pump unit 3 that is used, the layout and configuration of sprinklers 1 and pipe 2, etc.

As shown in FIG. 1, air exhaust system 12 may include a line 13. Line 13 may be coupled or attached to pipe 2. Line 13 may be configured to accelerate the evacuation or exhaustion of air from pipe 2.

Air exhaust system 12 may include a valve 14. Valve 14 may be selectively opened and closed by, e.g., control unit 5. For example, when detection unit 9 signals to control unit 5 that a sprinkler 1 is activated, control unit 5 may transmit a message or signal to valve 14 to open. Valve 14 may be opened to accelerate a removal or exhaustion of air from pipe 2. For example, rather than simply rely on a discharge of air through a nozzle of a sprinkler 1, valve 14 may be used to enhance the rate at which fluid is inserted or injected into pipe 2 (e.g., by way of pump unit 3).

Air exhaust system 12 may include a detection unit 15. Detection unit 15 may be coupled to one or more components or devices, such as line 13. Detection unit 15 may perform any number of functions. For example, detection unit 15 may be configured to detect or determine when valve 14 should be closed after it has been opened. Detection unit 15 may monitor or measure one or more parameters, such as pressure, flow, conductivity, or the like. Based on the measurement, detection unit 15 may determine that fluid has entered pipe 2 (e.g., via pump unit 3). In response to that determination, detection unit 15 may signal to, e.g., control unit 5 that valve 14 should be closed. Closing valve 14 after having detected fluid in pipe 2 may help to ensure that a maximum amount of fluid is directed out of sprinklers 1.

In some embodiments, valve 14 may be closed after a pre-determined time has elapsed. In some embodiments, valve 14 may be closed within a period of time. For example, the valve 14 may be closed responsive to detecting liquid in the pipe 2, optionally in an amount, volume, or quantity greater than a threshold. In some embodiments, the valve 14 may be closed prior to liquid entering the pipe 2, optionally in connection with a predetermined time period.

In some embodiments, closing valve 14 after a predetermined time has elapsed may mean that pipe 2 was not necessarily (totally) emptied of gas. For example, a remainder of the gas may be pushed out of pipe 2 through one or more (activated) sprinklers 1.

Air exhaust system 12 may include a termination unit 16. Termination unit 16 may be coupled to one or more components or devices, such as line 13. Termination unit 16 may be used to prevent a system failure in the event that line 13 cannot be closed when needed. For example, termination unit 16 may be used in the event that valve 14 fails to close. Termination unit 16 may prohibit a continuous flow of fluid through line 13. For example, termination unit 16 may stop the flow of fluid at an interface between termination unit 16 and line 13.

Termination unit 16 may be composed of one or more devices or entities. For example, termination unit 16 may include a closed container. The closed container may include, or be analogous to, a pressure vessel that can be rated or configured to withstand a specified pressure. In some embodiments, the closed container may be configured to prevent liquid from passing through it. In some embodiments, the closed container may be configured to allow, or not allow, gas to pass through it.

In some embodiments, termination unit 16 may include a second valve, which may be in addition to valve 14. In some embodiments, the second valve may comprise a pressure relief valve that may be configured to release air in the event air pressure exceeds a threshold, but the pressure relief valve might not pass any fluid. In some embodiments, the second valve may be configured to prevent liquid from passing through it. In some embodiments, the second valve may be configured to allow, or not allow, gas to pass through it.

System 100 is illustrative. In some embodiments, some of the components or devices (or portions thereof) may be optional. In some embodiments, additional components or devices not shown may be included.

In some embodiments, the components and devices may be arranged or configured in a manner different from what is illustrated in FIG. 1. In some embodiments features may be implemented in a nozzle associated with a sprinkler 1. For example, the functionality and/or components described above in connection with air exhaust system 12 (or portions thereof) may be located in sprinkler 1. Other modifications and variations on the system 100 shown in FIG. 1 are within the scope and spirit of this disclosure.

Figure 2:
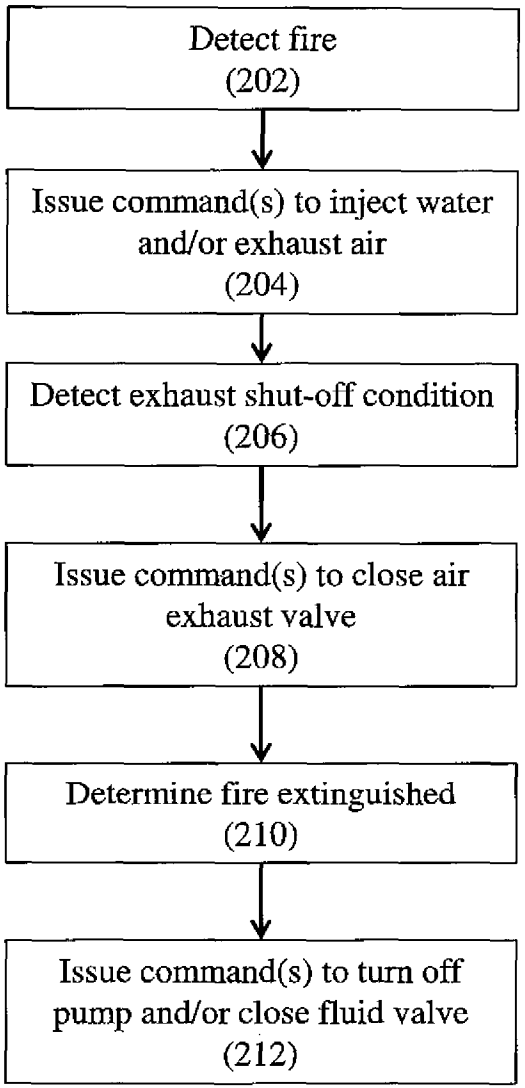
FIG. 2 illustrates a method of operating a sprinkler system in an exemplary embodiment.

FIG. 2 illustrates a method of operating a system in an exemplary embodiment. The method of FIG. 2 is described in connection with the components and devices shown in FIG. 1. The method of FIG. 2 may be adapted to accommodate different architectures or platforms. The method may be used to turn on a sprinkler and/or selectively open or close a pipe or line, such as an air exhaust line.

In step 202, a potential or actual fire may be detected. The fire may be detected, in effect, by detection unit 10. Alternatively, or additionally, the fire may be detected by detection unit 9 in response to, e.g., a sprinkler 1 being activated. For example, a sprinkler 1 could be activated as part of a test to verify the operation of system 100 (or one or more components or devices associated with system 100).

In step 204, one or more commands may be issued. For example, one or more commands may be issued by control unit 5. The messages issued by control unit 5 may direct one or more components or devices to take an action. For example, as part of step 204, control unit 5 may direct controller 4 to turn on pump unit 3. Control unit 5 may direct valve 6 and/or valve 14 to open. Opening valve 6 may ensure that fluid (e.g., water) provided by pump unit 3 is inserted or injected into pipe 2. Opening value 14 may assist in exhausting any air that may be present in pipe 2 by providing a path (in addition to any path that may be provided through a nozzle of sprinkler 1) for the air through line 13.

In step 206, an air exhaust shut-off condition may be detected. For example, detection unit 15 may determine that fluid has entered pipe 2 based on a pressure measurement (e.g., a pressure measurement when line 13 is closed), an absolute minimum pressure measurement (e.g., a pressure that is dependent on line 13 and actual system volumes), a conductivity measurement (e.g., water and air have different conductivities), or via any other measurement technique. The measurement may be taken in connection with line 13. As part of step 206, detection unit 15 may transmit a message to control unit 5 advising of the entry of fluid into pipe 2.

In step 208, one or more (additional) commands may be issued. For example, control unit 5 may cause valve 14 to close in response to the message received from detection unit 15 in connection with step 206. Closing valve 14 may help to ensure that fluid provided by pump unit 3 is directed to the output of sprinkler(s) 1, as opposed to being conveyed through line 13.

In step 210, a determination may be made that the fire has been extinguished. For example, if detection unit 10 was responsible for detecting the fire in step 202, and if detection unit 10 determines that the fire has been extinguished (or the symptoms of the fire, such as smoke, have subsided or been reduced below a threshold), such a determination may be conveyed by detection unit 10 to, e.g., control unit 5.

In step 212, one or more commands may be used to: (1) turn off pump unit 3, (2) cause valve 6 to close, and/or (3) turn on air compressor 7. For example, control unit 5 may: (1) command controller 4 to turn off pump unit 3, (2) cause valve 6 to close, and/or (3) turn on air compressor 7, in response to the determination made in step 210. In some embodiments, the commands may be based at least in part on input received from personnel. For example, fire department officials may determine that it is appropriate or safe to cease injecting fluid into pipe 2 and/or to cause any remaining fluid to be blown out of pipe 2.

The method of FIG. 2 is illustrative. In some embodiments, one or more steps (or portions thereof) may be optional. In some embodiments, additional steps not shown may be included.

Embodiments have been described in terms of the control and management of a sprinkler system. One skilled in the art will appreciate that embodiments may be adapted to accommodate different types of systems, such as different types of sprinkler systems.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Embodiments may be tied to one or more particular machines. For example, as described herein, detection units 9, 10, and 15, and control unit 5 may work in concert to selectively enable or disable one or more devices. For example, one or more pumps (e.g., pump unit 3), one or more valves (e.g., valves 6 and 14), and one or more air compressors (e.g., air compressor 7) may be selectively enabled/turned-on or disabled/turned-off based on one or more status indicators (e.g., one or more measurements).

Embodiments may transform an article into a different state or thing. For example, aspects of the disclosure may cause a pipe to be injected with a greater proportion of fluid (e.g., water) relative to air in a shorter amount of time. Such a transformation may be used to enhance the ability of a sprinkler system to extinguish a fire and/or provide for cost savings by maximizing the amount of fluid that is made available to extinguish a fire.

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A system comprising:

a gas exhaust line;

a valve coupling the gas exhaust line and a pipe;

a control unit configured to generate a command to open and close the valve, the control unit opening the valve to vent gas from the pipe and closing the valve; and a detection unit coupled to the gas exhaust line and configured to determine that liquid is in the pipe;

wherein the detection unit is configured to transmit a message to the control unit responsive to determining that liquid is in the pipe, and wherein the valve is configured to receive from the control unit a command to close based on the message.

2. The system of claim 1, wherein the detection unit is configured to determine that liquid is in the pipe based on a measurement conducted on the gas exhaust line, the measurement comprising of at least one of: pressure, flow, conductivity, and elapsed time.

3. The system of claim 1, wherein the control unit is configured to determine that there is a fire based on at least one of:

a pressure, a pressure derivative, or a gas flow associated with the pipe; and an input signal received from a flame/smoke detection unit advising of at least one of a flame and smoke.

4. The system of claim 1, further comprising:

a termination unit coupled to the gas exhaust line and configured to prevent a failure of a sprinkler system associated with the pipe when an attempted closure of the valve fails.

5. The system of claim 4, wherein the termination unit comprises at least one of:

a closed container configured to prevent liquid from passing through the closed container; and a second valve configured to prevent liquid from passing through the second valve.

6. The system of claim 1, wherein a sprinkler system associated with the pipe comprises a dry pipe sprinkler system, and wherein the control unit is distanced from the gas exhaust line.

7. The system of claim 1, wherein the valve is opened based at least in part on a measurement of at least one of a pressure, a pressure derivative, and a gas flow associated with the pipe.

8. The system of claim 4, wherein the termination unit comprises a pressure relief valve.

9. The system of claim 1, wherein:

the control unit sends a command to the valve to open in order to exhaust gas from the pipe of a sprinkler system through a line coupled to the valve, the command corresponding to a command to turn on a pump unit of the sprinkler system;

the detection unit determines that liquid provided at an output of the pump unit is present in the pipe;

the control unit sending a command to the valve to close in order to prohibit a flow of the liquid through the line.

10. The system of claim 9, wherein:

the control unit determines that a fire is extinguished;

the control unit sending a second command to the pump unit to turn off responsive to determining that the fire is extinguished;

the control unit sending a third command to a second valve, the third command directing the second valve to close in order to prohibit a further flow of the liquid into the pipe; and the control unit sending a fourth command to a gas compressor coupled to the pipe, the fourth command directing the compressor to force gas into the pipe in order to clear the pipe of the liquid.

11. The system of claim 10, wherein the second, third, and fourth commands are the same command.

12. The system of claim 9, wherein the command further corresponds to a command to open a second valve configured to provide the liquid from the output of the pump unit to the pipe.

13. The system of claim 9, wherein the determination that liquid provided at the output of the pump unit is present in the pipe is based at least in part on a predetermined time period.

* * * * *